United States Patent [19]

Chiba

[11] Patent Number: 5,055,834

[45] Date of Patent: Oct. 8, 1991

[54] ADJUSTABLE BILL-DAMAGE DISCRIMINATION SYSTEM

[75] Inventor: Teruhisa Chiba, Urawa, Japan

[73] Assignee: Laurel Bank Machines Co., Ltd., Tokyo, Japan

[21] Appl. No.: 180,832

[22] Filed: Apr. 12, 1988

[30] Foreign Application Priority Data

Apr. 13, 1987 [JP] Japan ..... 62-90135

[51] Int. Cl.[5] ..... G07D 7/00

[52] U.S. Cl. ..... 340/825.340; 382/7; 382/36; 382/57; 434/110

[58] Field of Search ..... 382/7, 36, 57; 340/825.34; 434/110

[56] References Cited

U.S. PATENT DOCUMENTS

| | | | |
|---|---|---|---|
| 4,311,914 | 1/1982 | Huber | 382/7 |
| 4,435,834 | 3/1984 | Pauli et al. | 382/7 |
| 4,550,433 | 10/1985 | Takahashi | 382/7 |
| 4,578,770 | 3/1986 | Mitani | 382/7 X |
| 4,710,963 | 12/1987 | Chapman et al. | 382/7 |

FOREIGN PATENT DOCUMENTS

| | | |
|---|---|---|
| 0109490 | 8/1983 | European Pat. Off. . |
| 3444543 | 12/1984 | Fed. Rep. of Germany . |
| 5952394 | 3/1984 | Japan . |
| 2088051 | 6/1982 | United Kingdom . |
| 2126718 | 3/1984 | United Kingdom . |

*Primary Examiner*—Ulysses Weldon

*Attorney, Agent, or Firm*—Fleit, Jacobson, Cohn, Price, Holman & Stern

[57] ABSTRACT

An adjustable bill-discrimination system which detects at least one of physical quantities of a bill and compares the detected data of the bill with a predetermined discrimination level to determine whether a bill is damaged or not, wherein a detection means detects at least one of physical quantities of a damaged bill selected by an operator. The detected physical quantities are stored in a memory means, and the data stored in the memory means are used as a level in accordance with which it is determined whether a bill is damaged or not; in other words, to discriminate damaged bills from clean ones. Preferably, the memory means is a reloadable memory means whereby data written to the reloadable memory means can be replaced by fresh data when an operator wishes.

3 Claims, 3 Drawing Sheets

ADJUSTABLE BILL-DAMAGE DISCRIMINATION SYSTEM

BACKGROUND OF THE INVENTION

1. Field of the Invention

The present invention relates to a bill-damage discrimination system incorporated in an apparatus for handling bills, such as a teller machine, a bill-binding machine and the like. More specifically, the present invention pertains to a bill-damage discrimination system wherein the bill-damage discrimination level can be set by an operator.

2. Prior Art Description

In a known bill-damage discrimination system, there is provided a level-setting switch to set a level in accordance with which it is judged whether a bill being transferred through the system is damaged or not. A bill judged to be damaged is discriminated relative to clean bills and is ejected from the system. This type of system is, for example, disclosed in Japanese Patent Public Disclosure No. 59-52394, wherein there is provided a detection system comprising photoelectric transfer elements for detecting a set of characteristic data for each of a plurality of bills representing different degrees of bill damage. The detected characteristic data are stored in a permanent memory means, and the data are then modified for use in setting bill-damage discrimination levels. By means of a level-setting switch, an operator can select a bill damage discrimination level. Thus, a bill with a degree of damage that is higher than the selected level is discriminated and separated from clean bills.

The known discrimination system, however, is at a disadvantage in that the judgement, levels of bill-damage discrimination are fixed and cannot be changed by an operator, who can only select a level by the level-setting switch. Further, the relationship between the selected discrimination level and the actual degree of bill damage is unknown to the operator, requiring that actual discrimination using the selected level be performed in order to recognize this relationship.

SUMMARY OF THE INVENTION

Therefore, it is an object of the present invention to provide a bill-damage discrimination system in which a desired bill-damage discrimination level by which a damaged bill is discriminated can be set directly by an operator using a real damaged bill.

Another object of the present invention is to provide a bill-damage discrimination system wherein a plurality of bill-damage discrimination levels can be directly set by an operator using real damaged bills with varying levels of damage, and any one of the bill-damage discrimination levels can be selected to determine whether a bill is damaged or not.

Still another object of the present invention is to provide a method of setting at least one discrimination level which is used to determine whether a bill is damaged or not, wherein an operator can set such a discrimination level by using a bill which is damaged to a certain degree.

According to the present invention, there is provided a bill-damage discrimination system which detects at least one physical quality of a bill and compares the detected data of the bill with a predetermined discrimination level to determine whether a bill is damaged or not, wherein a detection means detects at least one physical quality of a damaged bill selected by an operator. The detected physical qualities are stored in a memory means, and the data stored in the memory means are used as a level in accordance with which it is determined whether a bill is damaged or not i.e., to discriminate damaged bills from clean ones. In a preferred embodiment of the invention, a detection means detects physical data of damaged bills selected by an operator as being representative of bill-damage levels. The detected data are stored in a memory means, and one set of detected data obtained from a bill is selected as a discrimination level which is used to determine whether a bill is damaged or not. In a further preferred embodiment, the memory means is a reloadable memory means whereby data written to the erasable memory means can be replaced by fresh data when an operator wishes.

In another aspect of the present invention, there is provided a method of setting a bill-damage level in a bill-damage discrimination system, wherein a damage level is set by detecting at least one physical quality of a damaged bill selected by an operator and storing the detected data in a memory means. The stored data are used as a discrimination level to determine whether a bill is a clean bill or a damaged one to be excluded.

According to the present invention, one or more desired damage levels for determining whether a bill is damaged or not can be set by an operator using one or more bills, so that the operator can readily realize the actual degree of damage in a bill corresponding to a selected discrimination level. Furthermore, in a preferred embodiment, a damage discrimination level set by an operator can easily be changed to another one using another damaged bill selected by the operator.

The above and other objects and advantages of the invention will become apparent upon reading the following detailed description in connection with attached drawings.

DETAILED DESCRIPTION OF PREFERRED EMBODIMENT

While the invention will be described in connection with a preferred embodiment, it will be understood that we do not intend to limit the invention to this embodiment. On the contrary, we intend to cover all alternatives, modifications, and equivalents as defined by the attached claims.

Figure 1:
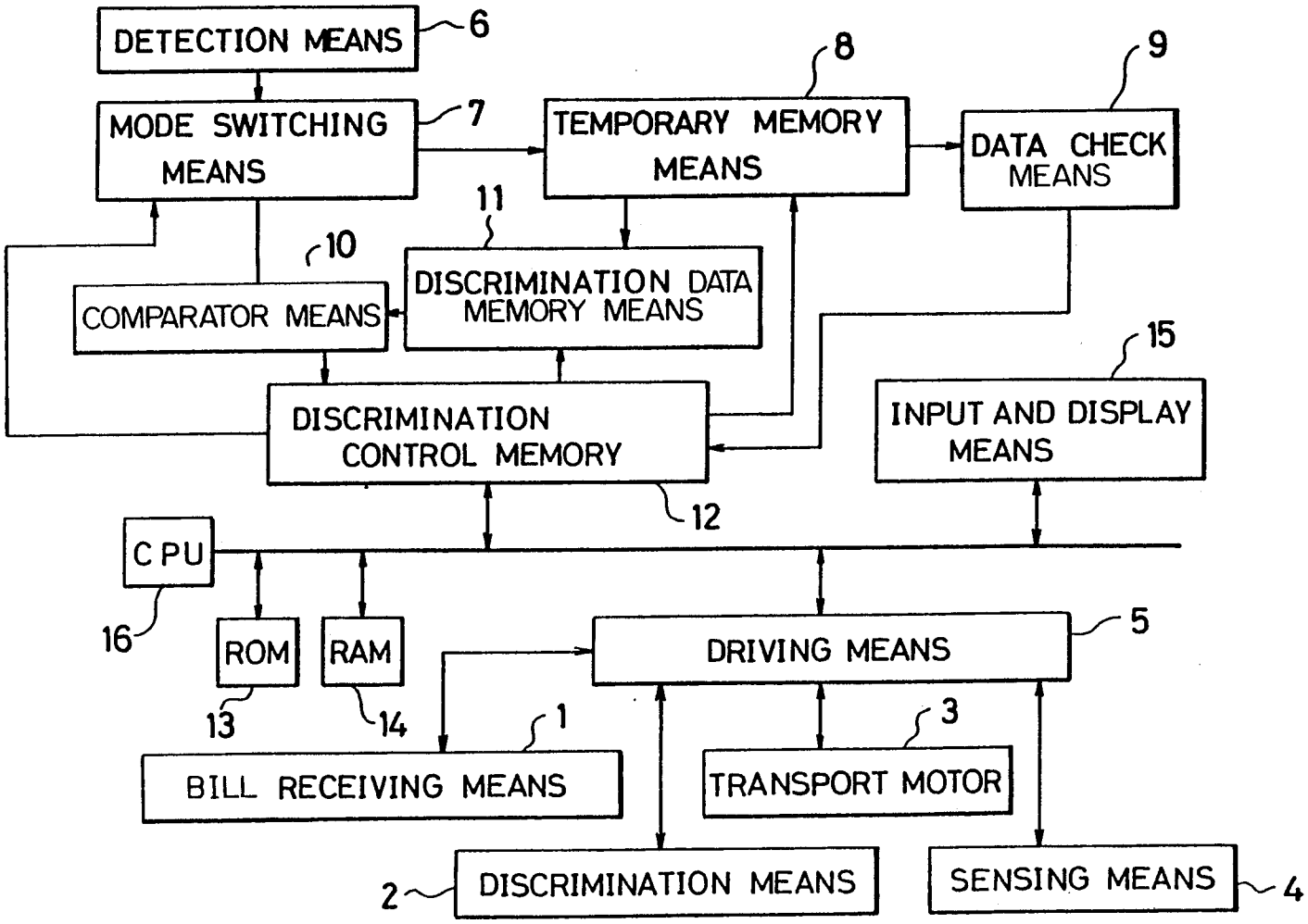
FIG. 1 is a schematic view illustrating an example of a bill-damage discrimination system according to the present invention.

With reference to the drawings, there is illustrated a bill-damage discrimination system according to the present invention. With reference to FIG. 1, the present system comprises bill receiving means 1, discrimination means 2 for discriminating a bill damaged to a degree that exceeds a predetermined level from clean bills, a transport motor 3 for driving a bill-transport means (not shown), and a set of sensing means 4 for sensing positions of bills transported by the transport means, operating conditions of bill receiving means 1 and discrimination means 2, and the like. Driving means 5 is provided to control the above means 1 to 4.

The system also comprises a detection means 6 which detects a bill transported by the transport means to obtain data thereof for determining whether the bill is genuine or not, the denomination, and whether the degree of bill damage is lower than a preset discrimination level. In this embodiment, detection means 6 includes a light source and a photoelectric transfer element for receiving reflected light from a bill passing the source. The degree of bill damage is determined by the amount of reflected light received from a bill. Alternatively, the degree of bill damage may be determined by transmittance of bill. Mode switching means 7 is provided which changes the direction of detected data tranferred from detection means 6. Mode switching means 7 can be switched between a normal operating mode and a discrimination level setting mode. When the normal operating mode is selected, the detected data from detection means 6 are transferred through mode switching means 7 to comparator means 10. Standard discrimination data are stored beforehand in a discrimination data memory 11 and are used for determining whether a bill is genuine or not, the denomination, and whether the degree of bill damage is lower than a predetermined level. These discriminations are made in comparator means 10.

Discrimination data memory means 11 includes a ROM and a reloadable memory. Standard data other than data representing damage discrimination levels, are stored beforehand in the ROM, while the data for the bill-damage discrimination levels and respective discrimination numbers are stored in the reloadable memory while in the damage level setting mode. When the level setting mode is selected, only detected data representing the degree of bill damage of a detected bill are transferred through mode switching means 7 to temporary memory means 8 and are stored therein. The stored data are then examined for errors by data check means 9. If the stored data contain no errors, they are transferred to the erasable memory of discrimination data memory means 11 and are stored therein.

The above means 7 to 11 are controlled by discrimination control means 12. For example, discrimination control means 12 applies a mode selection signal to mode switching means 7 to set the normal operating mode or the level setting mode. If errors are found in the stored data by error data check means 9, discrimination control means 12 sends a data cancellation signal to the temporary memory 8 to cancel the stored data. In the level setting mode, when a request is made to replace the stored data in the reloadable memory of discrimination data means 11, memory discrimination control means 12 sends a signal to the reloadable memory to enable the data stored therein to be replaced by data from the temporary memory 8.

The system also includes a ROM 13 for storing control programs thereof and a RAM 14 working area for the control programs. The system is provided with input and display means 15 by which data can be entered into the system and displayed. The above parts 12 to 15 are controlled by a CPU 16.

Figure 2:
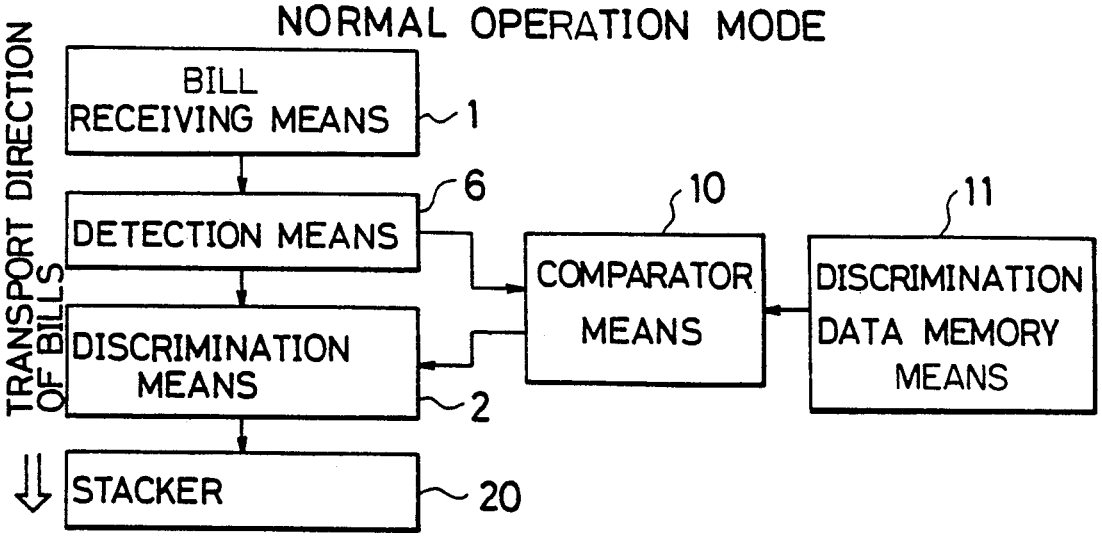
FIG. 2 is a block diagram of the circuitry of the system of FIG. 1 used for normal system operation.

Referring now to FIG. 2, the normal operation mode will be explained. In FIG. 2, a bill received by bill receiving means 1 is transferred to detection means 6. Detection means 6 detects physical qualities of the bill which include data for determining whether the bill is genuine or not, the denomination, and the damage degree thereof. The detected data are transferred through mode switching means 7 to comparator means 10. The following description is made only with respect to the bill-damage discrimination operation. In the reloadable memory, several sets of damage discrimination data have been stored, together with damage level numbers while in the previous level setting mode. In comparator means 10, the detected data representing the degree of bill damage is compared with damage discrimination data selected by the operator, whereby the detected bill is determined to be damaged if the detected damage degree is higher than the selected level. Otherwise, the detected bill is judged to be a clean one. A signal representing the results of the comparison is sent from comparator means 10 to discrimination means 2 which in turn discriminates the bill transferred thereto according to the result of the comparison. Clean bills separated from damaged bills in discrimination means 2 are transferred to and stacked in the clean-bill stacking portion of a stacker 20 while damaged bills are stacked in the damaged-bill stacking portion of the stacker 20.

Figure 3:
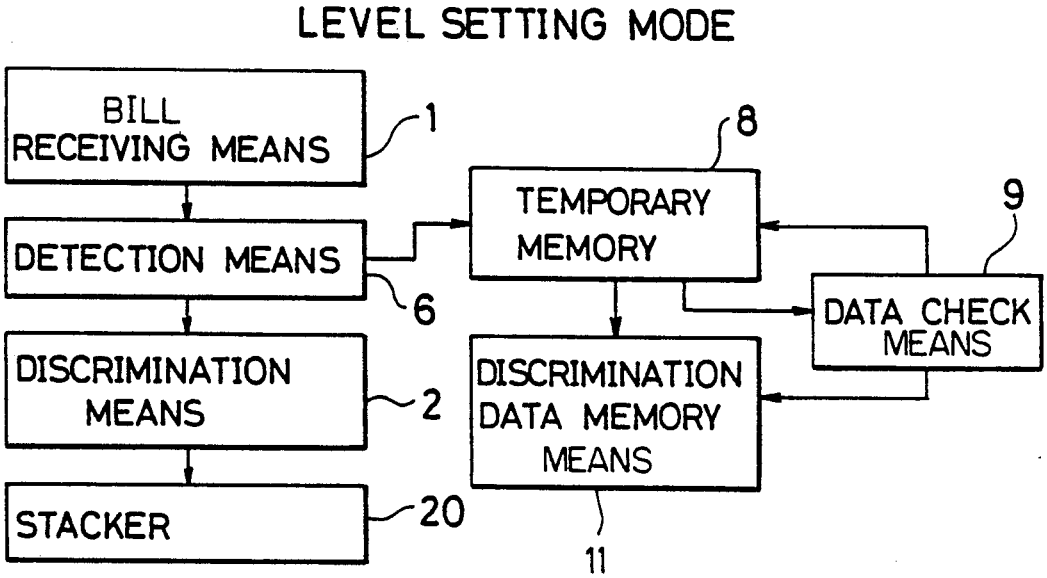
FIG. 3 is a block diagram of the circuitry of the system of FIG. 1 used for the discrimination level setting mode of the system.

Next, with respect to FIG. 3, the discrimination level setting mode will be explained. In this mode, a sample damaged-bill selected by an operator is received by bill receiving means 1 and is transferred to detection means 6. In detection means 6, data representing the degree of damage of the sample bill are detected, which are then transferred to and stored in the temporary memory 8. The data stored in the temporary memory 8 is sent to data check means 9 wherein data are examined for errors. This error check may be carried out by comparing the detected data with data that have been obtained from other damaged bills and already stored in the temporary memory 8, and determining whether the detected data differ substantially. If the data contain no errors, they are stored in the erasable memory of discrimination data memory means 11 as a damage discrimination level, whereas if errors are detected in the data, the temporary memory 8 is cleared, and the system is prepared for re-detection of the same sample bill. The sample bill passing through detection means 6 is transferred through discrimination means 2 to the stacker 20. Thus, the desired damage discrimination level is set by using a sample bill selected by the operator.

Figure 4:
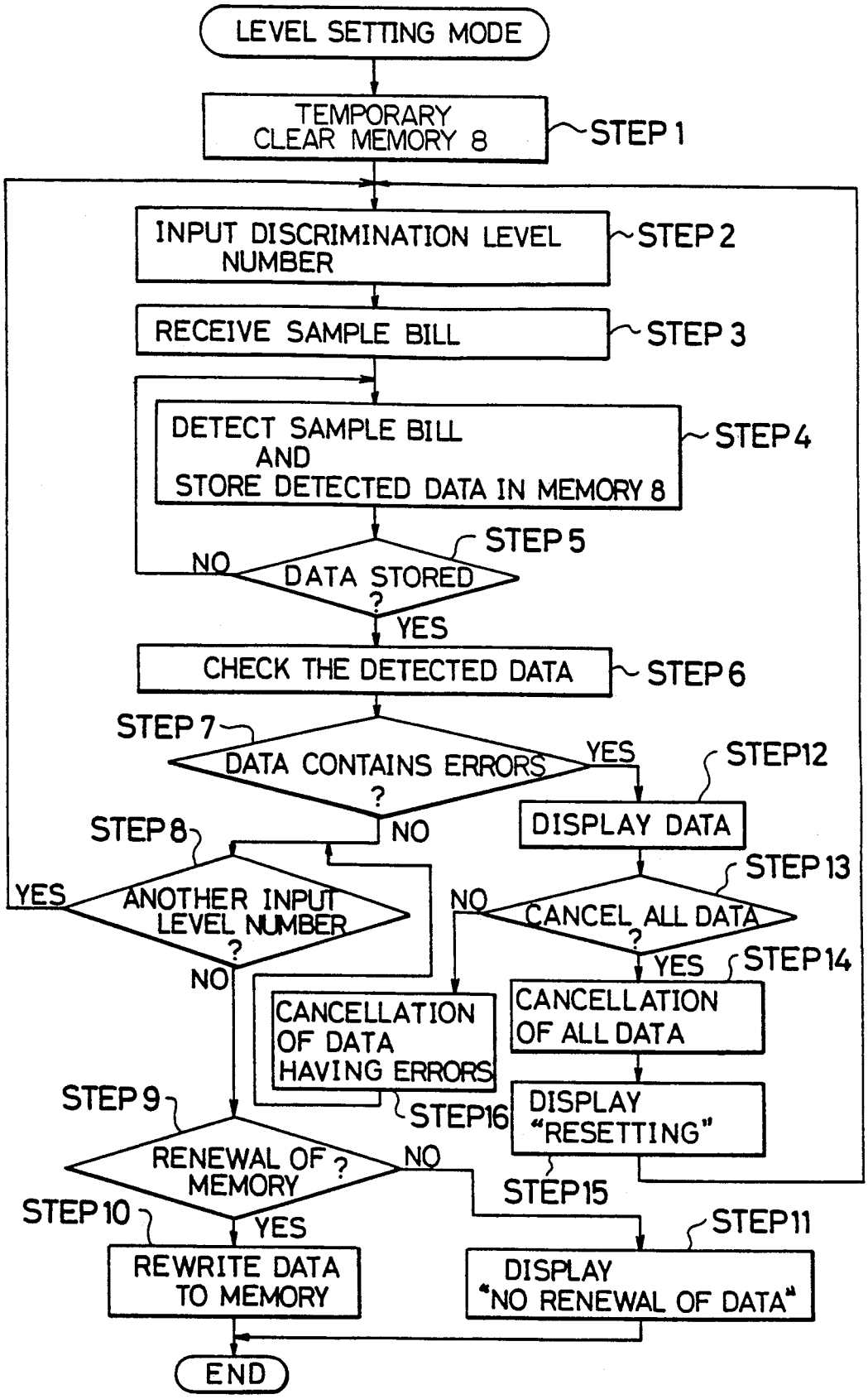
FIG. 4 is a flowchart showing the process of setting a discrimination level performed by the system of FIG. 1.

The level setting mode will be further described with reference to the flowchart of FIG. 4. At first, in response to depression of an all-clear key (not shown) disposed on a console panel of input and display means 15 by an operator, a signal is generated in the input means and is sent to the CPU 16. In response to the signal the CPU 16 controls discrimination control memory means 12 to clear the temporary memory 8 (step 1). Then the operator inputs a desired damage level number via ten keys disposed on the console panel, which is stored in a predetermined area of the temporary memory 8 under the control of the CPU 16 (step 2). The CPU controls driving means 5 to drive receiving means 1, so that receiving means 1 receives a bill to be discriminated (step 3). Next, the transport means is driven by the CPU 16 to transport the bill passing through bill receiving means 1 to detection means 6 wherein data are obtained from the bill representing the degree of damage thereof. The detected data are stored in the temporary memory 8, together with the damage level number (step 4). Completion of storing the detected data in the temporary memory 8 is detected (step 5), and then detected data is screened for errors (step 6). If the data have no errors (step 7) a judgment is made as to whether another damage level number should be input by the operator (step 8). If another damage level number is put, the control goes back to step 2 and carries out the same process represented by steps 2 to 8. Thus, in the temporary memory 8 are stored a plurality of detected data representing respective degrees of damage, together with respective damage level numbers. If there is no input of damage level number, display is made by the input and display means 15 so as to ask the operator if the data stored in the reloadable memory of discrimination data memory means 11 should be replaced with the data stored in the temporary memory 8 (step 9). If the operator instructs the system to rewrite the erasable memory through the console panel (step 9), discrimination control means 12 is controlled by the CPU 16 to drive discrimination data memory means 11 so as to store the data in the temporary memory 8 into the reloadable memory thereof (step 10), whereby the replacement of damage discrimination levels utilized in bill-damage discrimination is completed. If the operator instructs the system not to replace the data stored in the reloadable memory, input and display means 15 indicates that replacement of the damage discrimination level is not required (step 11).

In addition, if the stored data in the temporary memory 8 are determined to have errors in step 7, a message that the data contain errors is displayed by input and display means 15 (step 12). Next, if an instruction is input by the operator that all the stored data in the temporary memory 8 should be cancelled (step 13), under the control of the CPU 16 discrimination control means 12 is driven to clear the temporary memory 8 (step 14) and then displays a message to instruct resetting (step 15). Thereafter, the control goes back to step 2. If an instruction is input by the operator that only the data having errors in the temporary memory 8 should be cancelled in step 13, only the data having errors is cleared from the temporary memory 8 (step 16) and the control goes to step 8. Thus, a desired damage level for discriminating bill damage can be set by the operator using damaged bills.

I claim:

1. An adjustable bill-damage discrimination system which detects at least one physical quality of a bill and compares detected data of the bill with a predetermined discrimination level to determine whether or not the bill is damaged, said system comprising:

detection means for detecting at least one physical quality of a sample bill selected by an operator and for generating data representing a degree of detected bill damage, memory means for storing said data detected by said detection means of a degree of bill damage as said predetermined discrimination level, said memory means being a reloadable memory which can be rewritten with fresh detected data by said detection means of a degree of bill damage obtained from a new sample bill selected by an operator, said reloadable memory having areas for storing a plurality of said detected data, input means for inputting damage level numbers, said reloadable memory having areas for storing said damage level numbers as well as said detected data, and level selecting means for selecting one of said level numbers to thereby select the corresponding detected data for a damage discrimination level.

2. An adjustable bill-damage discrimination system comprising detection means for detecting data of sample bills and for detecting data of discriminated bills, memory means for storing said data detected from said sample bills as bill-damage discrimination levels, discrimination level selecting means for selecting one of said bill-damage discrimination levels, comparator means for comparing said data detected from one of said bills to be discriminated with said data stored in said memory means and corresponding to said selected bill-damage discrimination level, discrimination means for receiving the results of a comparison in said comparator means and determining whether a bill to be discriminated is damaged or not, mode selecting means for selecting an operation mode of the system from a normal operation mode and a discrimination level setting mode, and control means which controls in the normal operation mode so that data detected in said detection means for said discriminated bills are sent to said comparator means and are compared in said comparator means with the stored data in said memory means for said sample bills to thereby determine whether the bill of said detected data is damaged or not, while said control means controls in the bill-damage discrimination level setting mode so that data detected in said detection means for said sample bills are sent to said memory means and are stored therein instead of the data stored beforehand therein for other sample bills to thereby renew the discrimination level represented by said data stored in said memory means.

3. The system as set forth in claim 2, further comprising error check means for detecting errors of said detected data from said sample bill in the discrimination level setting mode and wherein said data, if containing errors, can be cancelled by said control means.

* * * * *